United States Patent [19]

Spencer et al.

[11] 4,401,158

[45] Aug. 30, 1983

[54] ONE TRIP MULTI-ZONE GRAVEL PACKING APPARATUS

[75] Inventors: Jack D. Spencer, Long Beach, Calif.; Joseph F. Donovan, Tomball, Tex.

[73] Assignee: Baker International Corporation, Orange, Calif.

[21] Appl. No.: 325,420

[22] Filed: Nov. 9, 1981

Related U.S. Application Data

[63] Continuation of Ser. No. 170,494, Jul. 21, 1980, abandoned.

[51] Int. Cl.[3] ..... E21B 33/124; E21B 34/14; E21B 43/04; E21B 43/10

[52] U.S. Cl. ..... 166/51; 166/113; 166/131; 166/191; 166/205; 166/278; 166/334

[58] Field of Search ..... 166/51, 278, 276, 334, 166/332, 184, 185, 191, 187, 127, 131, 205, 373, 386

[56] References Cited

U.S. PATENT DOCUMENTS

| | | | |
|---|---|---|---|
| 3,517,743 | 6/1970 | Pumpelly et al. | 166/127 |
| 3,987,854 | 10/1976 | Callihan et al. | 166/278 |
| 4,044,832 | 8/1977 | Richard et al. | 166/278 |
| 4,049,055 | 9/1977 | Brown | 166/131 X |
| 4,105,069 | 8/1978 | Baker | 166/332 X |
| 4,270,608 | 6/1981 | Hendrickson et al. | 166/278 |

*Primary Examiner*—Stephen J. Novosad
*Attorney, Agent, or Firm*—William C. Norvell, Jr.

[57] ABSTRACT

An apparatus is provided for gravel packing a plurality of zones within a subterranean well. Primary sealing means are adapted for setting in casing at a position above the zones. A plurality of sets of production screens and valve means are provided, the valve means being equal in number to the zones to be packed and being carriable in the well with the primary sealing means. Zone isolation means are connected between each said set and expansible into sealing engagement with the casing. A control mandrel includes a single cross-over means for diverting gravel carrying fluid. A plurality of vertically spaced sealing means are defined on the cross-over means for successively isolating each set from the others when the cross-over means is positioned in proximity to each valve means. Valve opening means are provided on the control mandrel and are operable by longitudinal movement of the mandrel to positions for opening and closing the valve means. Means for supplying gravel carrying fluid to the interior of the control mandrel is provided whereby each successive production zone may be gravel packed by successively moving the conduit and the mandrel assembly to cooperate with each of the sets, without retrieving the conduit from within the well.

5 Claims, 24 Drawing Figures

ONE TRIP MULTI-ZONE GRAVEL PACKING APPARATUS

This application is a continuation of application Ser. No. 170,494, filed July 21, 1980, now abandoned.

BACKGROUND OF THE INVENTION

1. Field of the Invention

This invention relates to a method and apparatus for effecting the gravel packing of a plurality of spaced production zones provided in a subterranean well by a single trip of a work string incorporating the gravel packing apparatus into the well.

2. Description of the Prior Art

Of considerable magnitude in the production of hydrocarbons, such as oil and gas, from a producing well is the problem of sand flow into the well bore from unconsolidated formations. Production of sand with the flow of hydrocarbons will cause the well bore to gradually fill up with minute sand particles until production perforations in the casing and, oftentimes, the end of production tubing inserted therein, are covered, resulting in a significant reduction in fluid production. In many instances, sand production will cause the well to stop producing.

In addition to reduction of fluid production, flow of sand also may cause severe damage to equipment, such as pumps, chokes and the like. In flowing wells, fluid velocity may be sufficient to scavenge sand within the well bore and produce it with the fluid hydrocarbon, resulting in holes being cut in the tubing and flow lines.

One well known means of controlling flow of sand into the well bore is the placement of gravel on the exterior of a slotted, perforated, or other similarly formed liner or screen (hereafter referred to as "production screen") to filter out sand produced with the oil or gas, and thus prevent its entry into the well bore. It is important to size the gravel for proper containment of the sand. Additionally, the slotted liner or screen must be designed to prevent entry of the gravel itself into the production tubing.

Although other fluids have been used, treated and filtered production or nearby well or surface water, to which is generally added a desired concentration of calcium chloride or other active substance, is preferably used in most gravel packing processes during the cleaning or flushing procedure. The water is treated to remove contaminates such as cement particules, scale, and other foreign material generally resulting from the circulation of the water in the well bore.

Apparatus for gravel packing production zones of wells are well known, and a variety of apparatus is commercially available for effecting such operation. See for example, U.S. Pat. Nos. 3,901,318, 3,913,676 and 4,044,832.

All of such prior art devices have, however, required multiple trips of the work string incorporating the gravel packing apparatus into the well in order to effect the gravel packing of a plurality of production zones.

It would be economically desirable where multiple production zones are to be gravel packed in a subterranean well, that the required multiple gravel packing operations should be capable of being accomplished in a single trip of the work string into the production zone of the well. The present invention affords such means and method.

SUMMARY OF THE INVENTION

The present invention provides an apparatus for effecting the sequential gravel packing of a plurality of vertically spaced production zones within a subterranean well having casing in place therein. The apparatus comprises primary sealing means, such as a hydraulically set packer, which is adapted for setting in the casing at a position above the production zones. A plurality of sets of production screens and valve means selectively movable between open and closed positions are provided, the valve means being equal in number to the production zones, the valve means being carriable in the well with the primary sealing means and extending in series therebelow. Production zone isolation means, such as a packer, are connected between each said set and are expansible into sealing engagement with the casing intermediate the adjacent production zones. A tubular control mandrel is provided and is carriable on a conduit in the well with the primary sealing means and is movable within all of the sets. The control mandrel includes a single cross-over means for diverting gravel carrying fluid from the interior of the mandrel to the exterior thereof. A plurality of vertically spaced sealing means are provided on the control mandrel for successively isolating each set from the others when the cross-over means on the control mandrel is positioned in proximity to each of the valve means. Means on the control mandrel are provided for opening the valve means by longitudinal movement of the control mandrel in a first direction and closing the valve means by longitudinal movement of the control mandrel in a second direction. Means are provided for supplying gravel carrying fluid to the interior of the control mandrel whereby each successive production zone may be gravel packed by successively moving the conduit and the mandrel assembly to cooperate with each of the sets, without retrieving the conduit from within the well during the sequential gravel packing of the well.

DESCRIPTION OF THE PREFERRED EMBODIMENTS

Figure 1A:
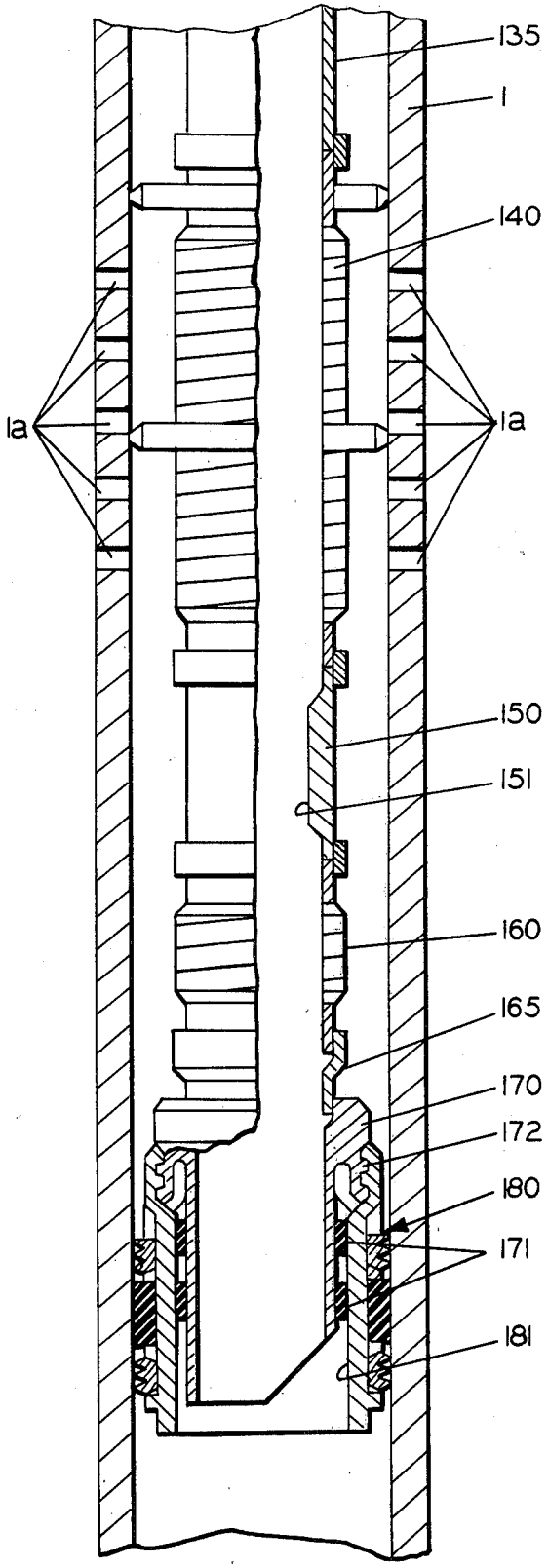
FIGS. 1*a*, 1*b*, 1*c*, 1*d* and 1*e* together constitute a schematic quarter section vertical elevational view of the zone isolation, production screen and sliding sleeve portions of a gravel packing apparatus of the present invention in a preferred form for the packing of two production zones in a single trip, FIG. 1*a* being the lowermost portion of the apparatus and FIGS. 1*b*, 1*c*, 1*d* and 1*e* respectively being successive upward continuation views.
Figure 2C:
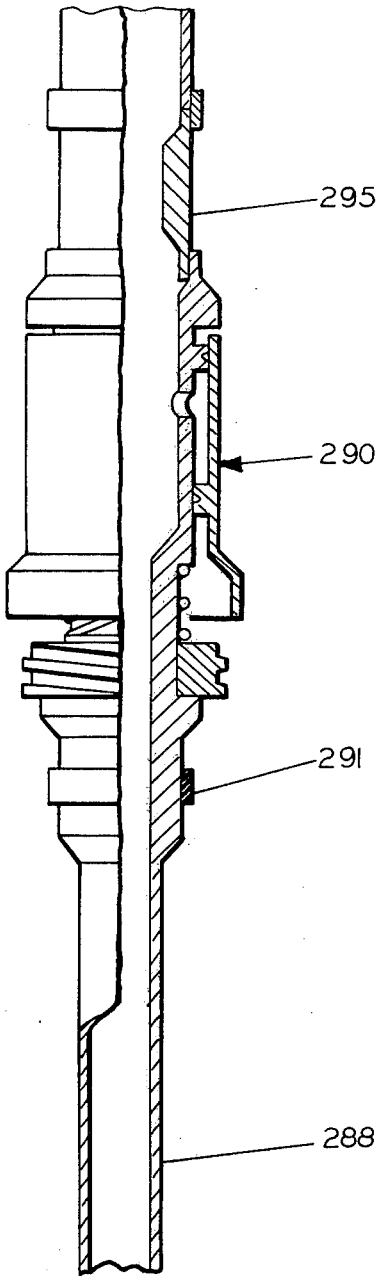
FIGS. 2*a*, 2*b*, and 2*c* together constitute a schematic quarter section vertical elevational view of a control mandrel assembly that is insertable within the gravel packing apparatus of FIG. 1 to control the direction of fluid flow and provide the required seals, FIG. 2*a* being the bottom of the tool, and FIGS. 2*b* and 2*c* respectively being successively upward continuation views.
Figure 1C:
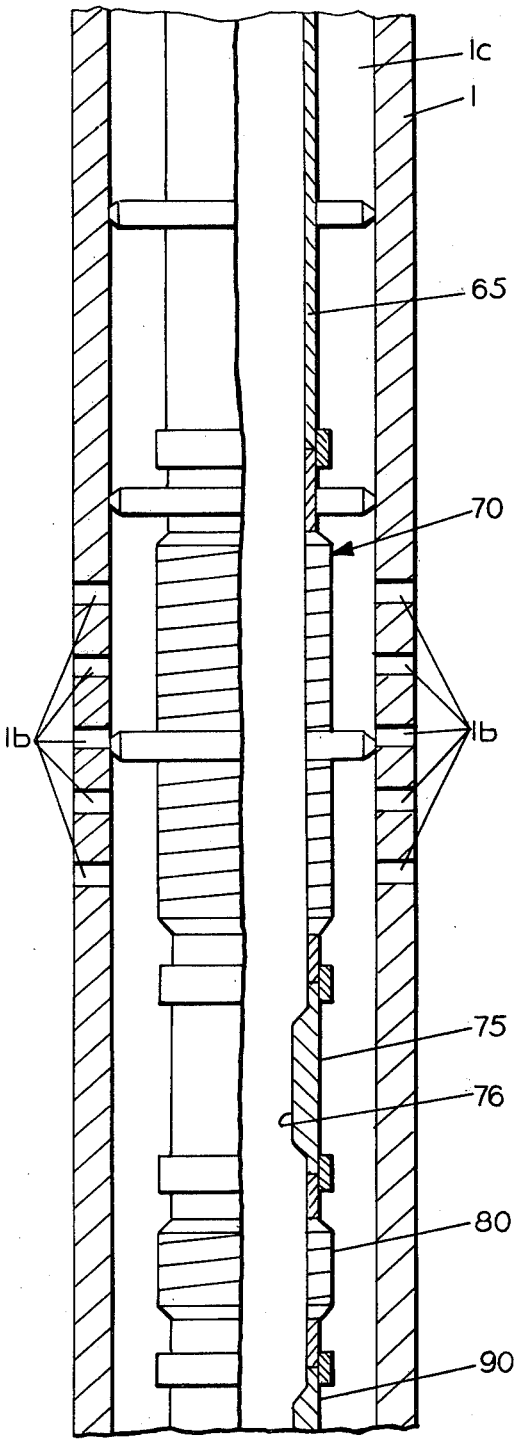
Figure 1B:
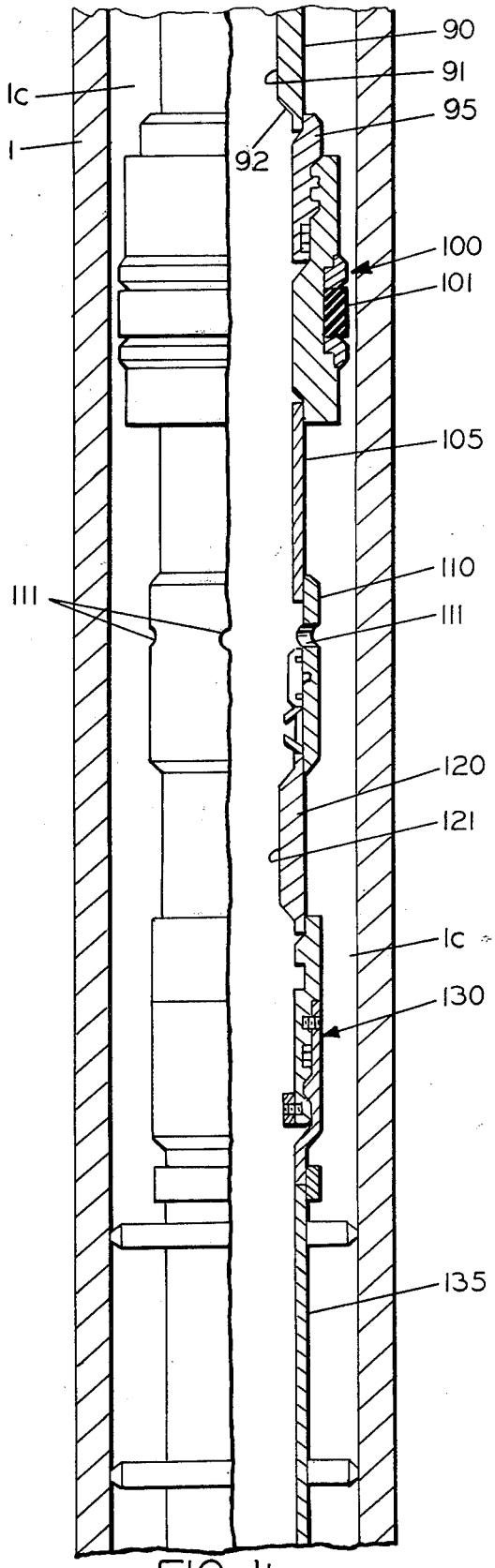
Figure 1E:
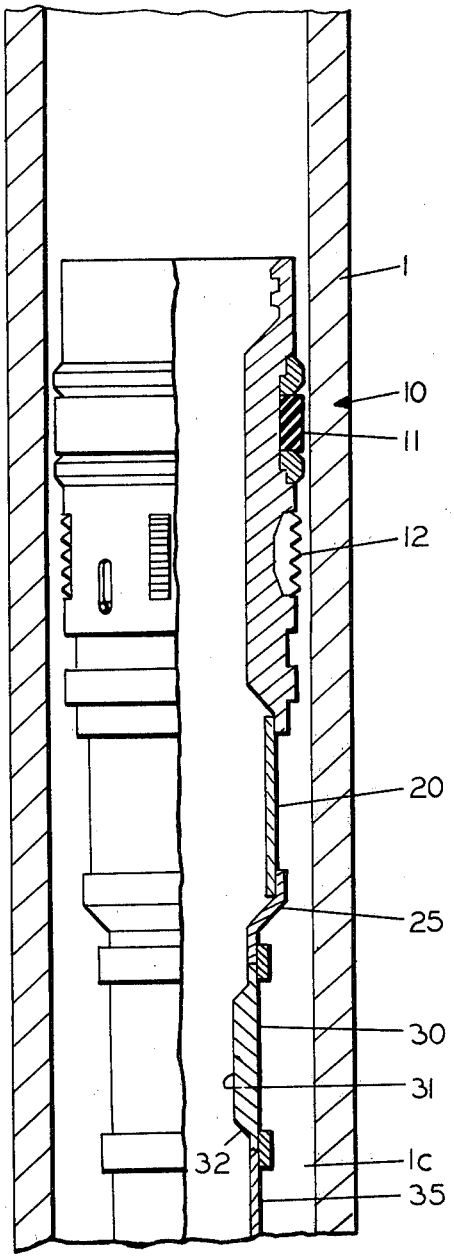
Figure 1D:
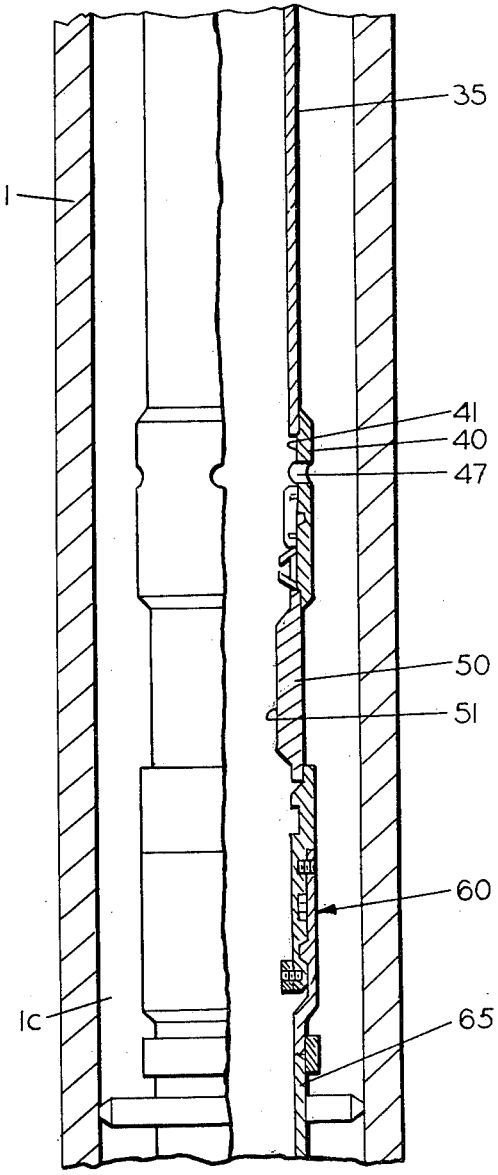
Figure 2B:
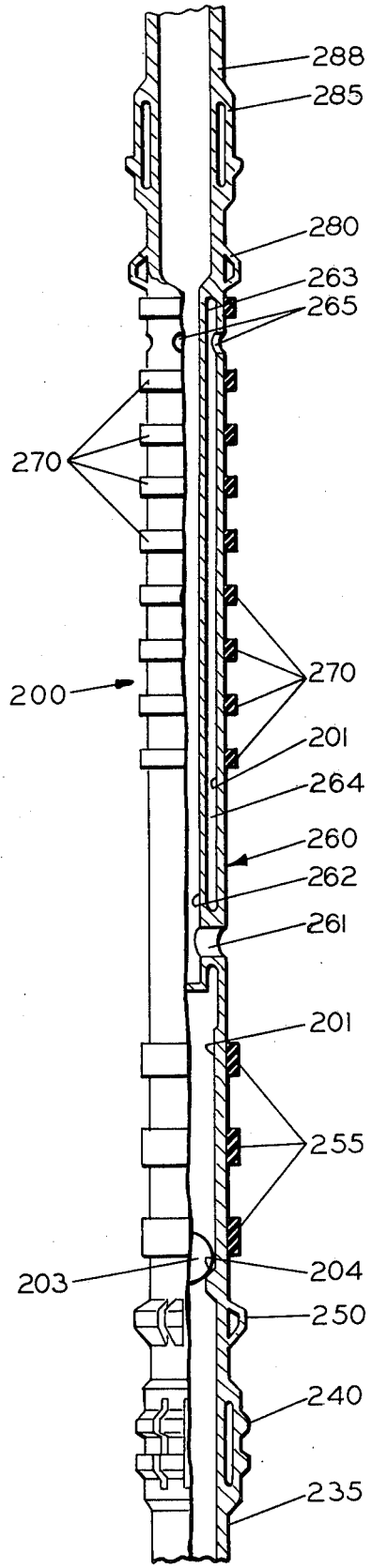
Figure 2A:
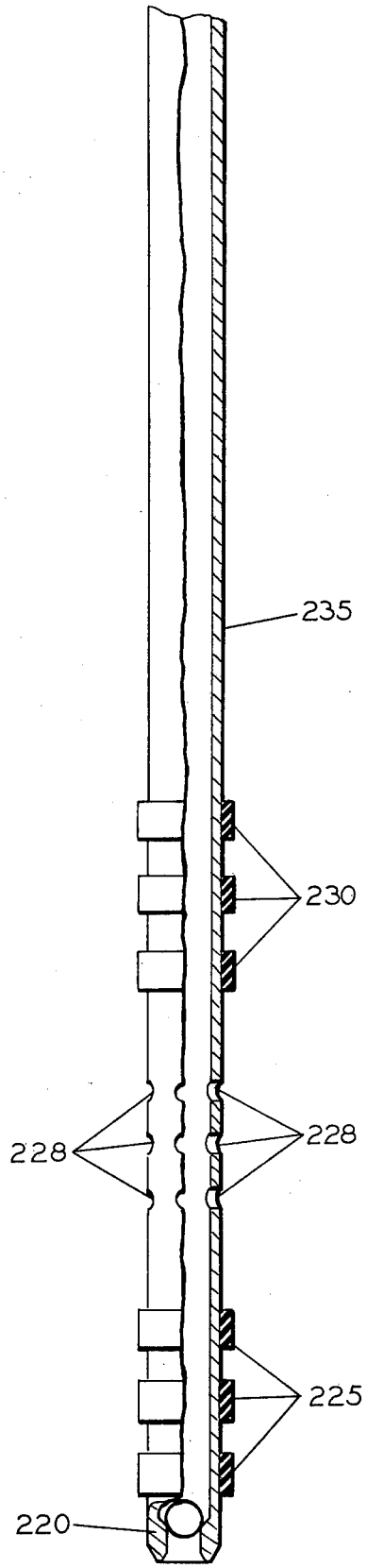

Referring now to FIG. 1, there is shown positioned within a well casing 1 an exterior apparatus for gravel packing two vertically spaced production zones, the interior portion or control mandrel, being shown in FIGS. 2*a*, 2*b* and 2*c*. The production zones are respectively represented at the vertically spaced sets of casing perforations 1*a* and 1*b*.

In the specific example to be described, wherein only two production zones 1*a* and 1*b* are involved, the required apparatus is assembled in vertically stacked relationship below a zone isolation means, such as a packer 10. The packer 10 is provided with an expandable packing element 11 for effecting a sealed engagement with the interior wall of the casing 1 at a region above the upper production zone. The packer 10 has a plurality of expandable slips 12 which engage the interior wall of the casing 1 to hold the packer 10 in a fixed position with respect to the casing 1. The packer 10 may be of any one of several well known, commercially available packers, such as the SC-1 packer manufactured and sold by Baker Sand Control Division, Baker International Corporation, of Houston, Tex. The particular type of packer is not critical, so long as it is capable of effecting a seal with the internal surface of the casing 1.

To the bottom of the packer 10 is affixed in conventional fashion to a mill-out extension 20, which is merely a sleeve-like element incorporated to provide adequate tubular conduit length below the packer 10 with a full diameter opening so that, in the event it is decided to retrieve the packer 10, the bottom of the retrieving tool can be accommodated.

Proceeding downwardly, a cross-over sub 25 effects the connection of the bottom of the mill-out extension 20 to a reduced diameter seal bore unit 30. As will be later described, the internal bore surface 31 of the seal bore 30 cooperates with annular sealing elements provided on the control mandrel 200 to control the fluid flow during gravel packing operations.

An extension sleeve 35 connects the seal bore unit 30 with the top of a sliding sleeve unit 40 and properly spaces such sliding sleeve unit relative to the seal bore unit. The sliding sleeve unit 40 is of conventional construction and in effect amounts to a sliding valve, operable by the mandrel 200, for controlling radial ports 47 to selectively permit fluid to communicate between the interior 41 of the sliding sleeve and the casing annulus 1*c* defined between the outside periphery of the gravel packing apparatus and the internal diameter of the casing 1.

The bottom end of the sliding sleeve unit 40 is connected to the top end of another seal bore unit 50, having an internal sealing surface 51, which, in cooperation with seals on the control mandrel 200, effects the direction of the flow of fluid from the interior of the gravel packing assembly to the exterior during the gravel packing operation.

The lower end of the seal bore unit 50 is secured to the top end of a shear-out safety joint 60 which permits release of component parts of the apparatus including the upper packer in the event that the apparatus becomes stuck in the well bore. The shear-out safety joint 60 may be of conventional construction.

The shear-out safety joint 60 is connected to the top end of a tubular section 65 which in turn is connected to the top end of the uppermost production screen 70 which, when the packer 10 is set, axially straddles the perforations 1*b* within the uppermost production zone. Again, the production screen 70 is of conventional construction and it is effective to filter out sand and other particulates from the produced fluid, permitting the filtered produced fluid to enter the interior of the gravel packing apparatus and through the production string, to the top of the well.

The lower end of the production screen 70 is connected to the top end of a seal bore 75 having an internal sealing surface 76 which functions in cooperation with sealing elements provided on the control mandrel 200, to direct fluid flow during gravel packing of the upper production zone immediate the casing perforations 1*b*. The lower end of sealing bore unit 75 is connected to the top end of a tell-tale screen 80, which is employed to insure that the gravel placement in the upper production zone 1*b* extends to the bottom of the intended longitudinal interval for gravel packing.

The bottom end of the tell-tale 80 is secured to a seal bore 90, the internal sealing surface 91 of seal bore 90 cooperating with sealing elements on the control mandrel 200 to, during gravel packing of the upper production zone, act as an isolator between the upper production zone and the lower production zone and, during the gravel packing of the lower production zone 1*a*, to act as a director of fluid.

The lower end of the seal bore unit 90 is connected to the top of a left-hand threaded connector sub 95 which, in turn, is threadably connected to a lower zone isolation means, such as packer 100 having a packing element 101.

The components below and including the isolation packer 100 constitute one "set" of gravel packing apparatus. The packer 100 may be of any one of a number of well known type of packers which effect a sealing engagement of a packing element 101 with the internal diameter of the casing 1. Its primary function is to isolate the upper production zone, particularly the casing annulus 1*c*, from the lower production zone, both during the gravel packing operation through the lower production zone and thereafter during production operations. Preferably, the packer 100 is set by fluid pressure transmitted down the tubing string, and into a self-contained setting mechanism.

The lower portion of the packer 100 is affixed to a large diameter sleeve-like extension 105 and the lower portion of the extension 105 is secured to the top end of a sliding sleeve 110. The function of sliding sleeve 110 is to provide temporary communication through radial ports 111 between the interior of the assembly and the annulus 1*c* between the o.d. of the assembly and the i.d. of the casing 1.

The lower end of the sliding sleeve 110 is affixed to the top end of a seal bore 120 having an internal sealing surface 121, which, in cooperation with sealing elements provided on the control mandrel 200, directs the flow of gravel and completion fluid to the lower production zone 1*a*.

The bottom end of the seal bore 120 is connected to a shear-out safety joint 130, which may be identical to the shear-out safety joint 60. Such safety joint is incorporated solely for purposes of retrieval of the apparatus. It permits the convenient retrieval of all apparatus above the shear-out safety joint 130 along with the top half of such shear-out safety joint. The bottom half of the safety joint 130 may be retrieved when the lower screen and liner assembly is retrieved.

The lower end of the shear-out safety joint 130 is affixed to the top end of a tubular section 135 and the lower end of the tubular section 135 is connected to the top end of a lower production screen 140.

The bottom end of the production screen 140 extends to a seal bore 150 having an internal sealing surface 151 to cooperate with seals provided on the control mandrel 200, to direct fluid flow through the lowermost tell-tale screen 160 which is connected to the bottom end of the seal bore 150 and, like the tell-tale screen 80 provided in the upper production zone, insures that the gravel placement has extended downwardly past the bottom of the screen interval.

The lower portion of the tell-tale screen 160 is conventionally connected to the top end of a cross-over sub 165 which merely effects a necessary reduction in diameter between the threaded connections on a standard tell-tale screen 160 and a snap latch 170 connected to the bottom end of the cross-over sub 165. The snap latch 170 is provided to engage the top end of a lower packer 180 which is anchored in the casing 1 at a predetermined position below the lowermost end of the perforations 1*a*. The external seals 171 provided on the body portion of the snap latch 170 are received in the bore 181 of packer 180 to eliminate any fluid flow across the bore 181 of the packer 180.

Referring now to FIGS. 2*a*, 2*b* and 2*c*, there is shown a control mandrel assembly 200 which is inserted within the aligned bores defined by the exterior gravel packing apparatus components shown in FIGS. 1*a* through 1*e*.

Now referring to FIG. 2*a*, the lowermost component of the control mandrel 200 is a check valve 220 which prevents fluid flow through the bottom end of the mandrel 200. This plug thus effectively prevents fluid transmission from within the control mandrel 200 to any area below the zone that is being gravel packed at a particular time. Immediately above the check valve 220 are a plurality of spaced external seals 225. During the gravel packing operation of the upper production zone, (FIG. 6*a*) the seals 225 cooperate with the interior surface 91 of the seal bore unit 90.

Figure 4A:
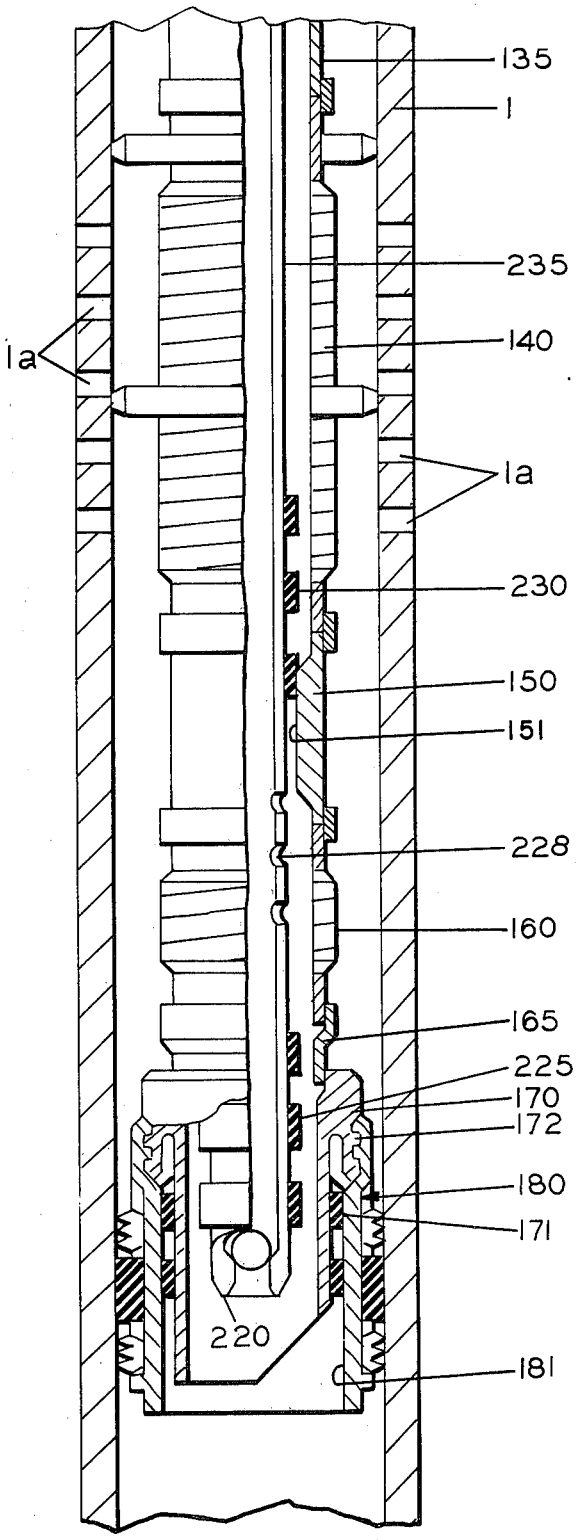
FIGS. 4*a*, 4*b*, 4*c*, 4*d* and 4*e* together constitute a schematic quarter section, vertical elevational view of the gravel packing apparatus with the elements thereof shown in the positions occupied in the initial gravel packing of the lowermost production zone, FIG. 4*a* being a view of the bottom of the apparatus, and FIGS. 4*b*, 4*c*, 4*d* and 4*e* respectively constituting successive upward continuation views.

Immediately above the external seals 225, there is provided a plurality of flow passageways 228 which take fluid returns from the lower tell-tale screen 160 when the control mandrel 200 is shifted to the position shown in FIG. 4*a*.

Above the flow passageways 228 there is provided a second set of external seals 230 which cooperate with the internal bore surface 151 of the seal bore unit 150 to direct fluid flow down through the lowermost tell-tale screen 160 during gravel packing operations in the lower production zone when the control mandrel 200 is positioned as in FIG. 4*a*.

Immediately above the seal units 230 there is provided a length of tubular conduit section 235. Above the section 235 is mounted a collet-configured shifting tool 240 which cooperates with the sliding sleeve apparatus 110 or 40 to effect the longitudinal movement of the sliding sleeve from one of open and closed positions to the other position as the control mandrel 200 is shifted longitudinally.

Immediately above the shifting tool 240 there is provided an indicating collet 250 which engages the shoulder 122 of the seal bore 120 and the shoulder 52 of the seal bore 50, to provide a signal to the operator at the surface to determine where the cross-over tool is located relative to the sliding sleeves 110 or 40. Additionally, when the control mandrel 200 is elevated to effect the gravel packing of the lower production zone, the indicating collet 250 engages the shoulder 122 on the seal bore 120. The indicating collet 250 may be of conventional construction, being radially compressible to move downwardly past a constricted shoulder, but requiring the application of a substantial tension force to compress the collet to permit it to pass upwardly through the restricted shoulder 122 of the seal bore 120, or shoulder 52 of the seal bore 50.

Figure 4C:
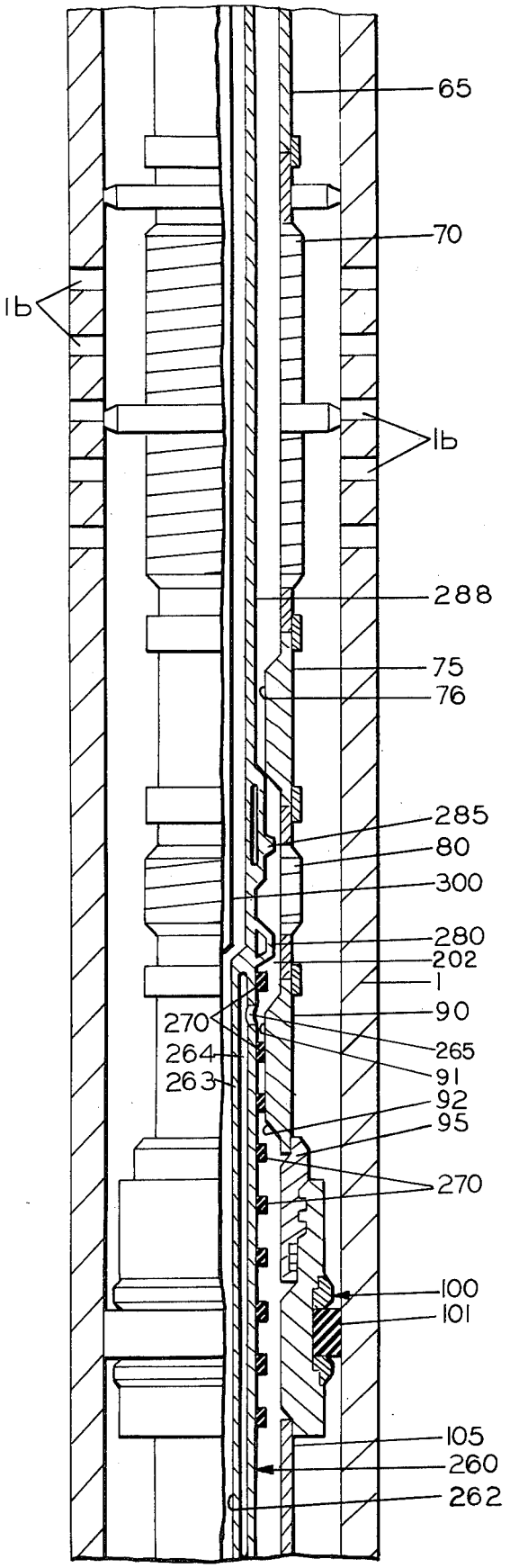
Figure 4B:
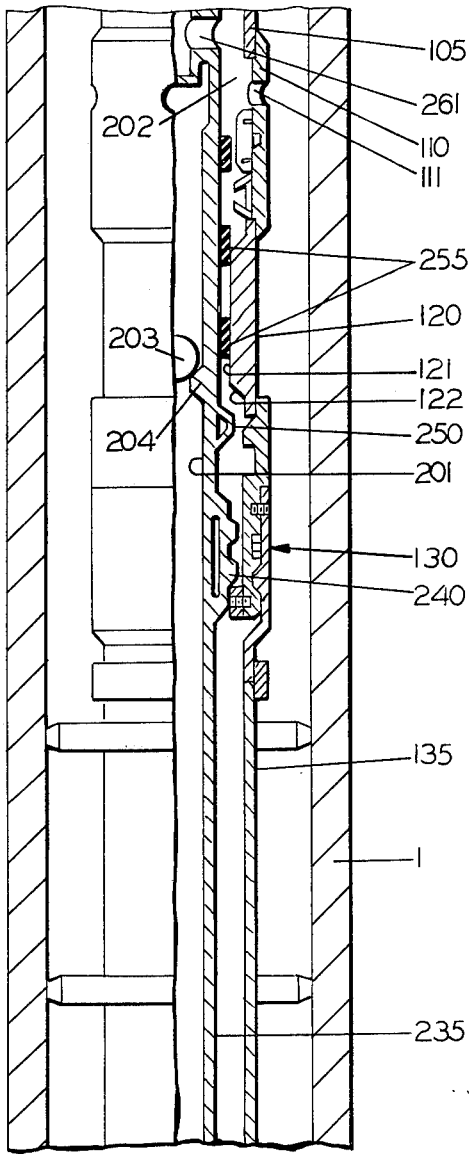
Figure 4D:
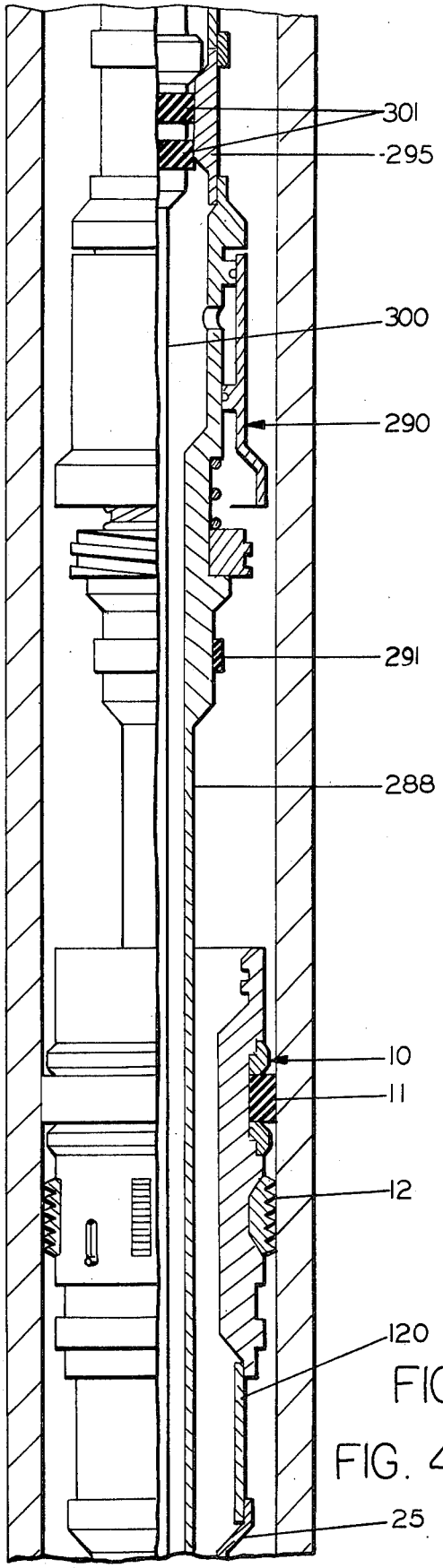
Figure 4E:
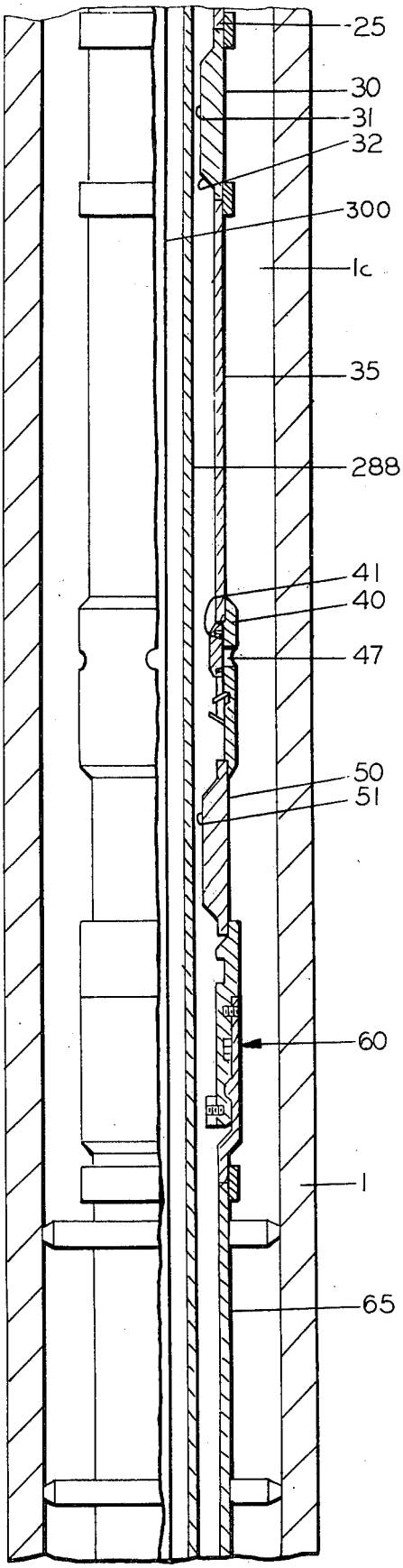

Immediately above the indicating collet 250, there is provided a series of external seals 255 which function as the bottom seal assembly in the cross-over tool 260. They are provided to prohibit flow going out the cross-over port 261 and down the interior of the screen liner assembly. The cross-over port 261 directs fluid from the flow passageway 262 of the cross-over tool 260 through the port 111 of the sliding sleeve 110 during gravel packing of the lower production zone, or through the port 47 of the sliding sleeve 40, during gravel packing of the upper production zone, to the casing annulus 1*c*, thence to the exterior of the production screen 140 or 70, respectively. The cross-over tool 260 may be of the same general configuration as that described in U.S. Pat. No. 4,044,832, and incorporates an inner tubular member 263 having the flow passageway 262 communicating with a concentric work string 300 (FIGS. 4*d* and 4*e*) which is run from the surface of the well interior of the tubular work string 5.

A fluid annulus 264 is defined between center tubular section 263 and the outer wall of the cross-over tool 260, and permits fluid transmission to the top of the well through the interior of the mandrel assembly 200 and from the flow passageways 228.

At the upper end of the cross-over tool 260, the annulus 264 communicates through radial ports 265 with the annulus 202 (FIG. 3*c*) between the control mandrel assembly 200 and the interior of the liner assembly.

The internal bore 201 of the control mandrel 200 is provided with an internally projecting ball valve seat 204 in the vicinity of the lowermost seal elements 255. A ball 203 is positioned on the seat 204 and is run into the well initially with the control mandrel 200 to act as a check valve during reverse circulation operations.

Figure 5B:
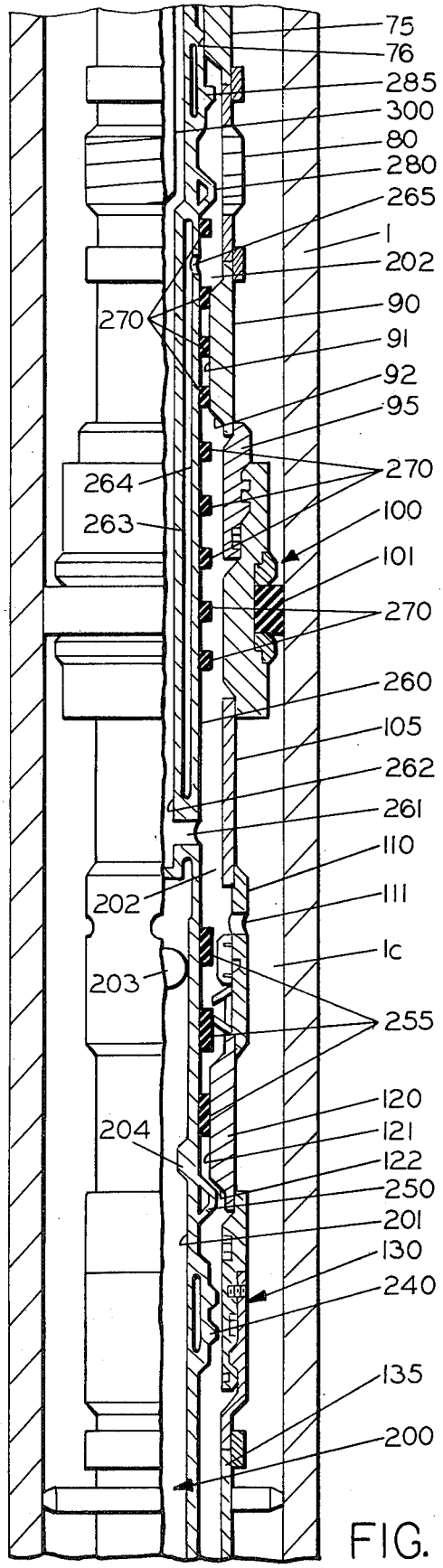
Figure 5A:
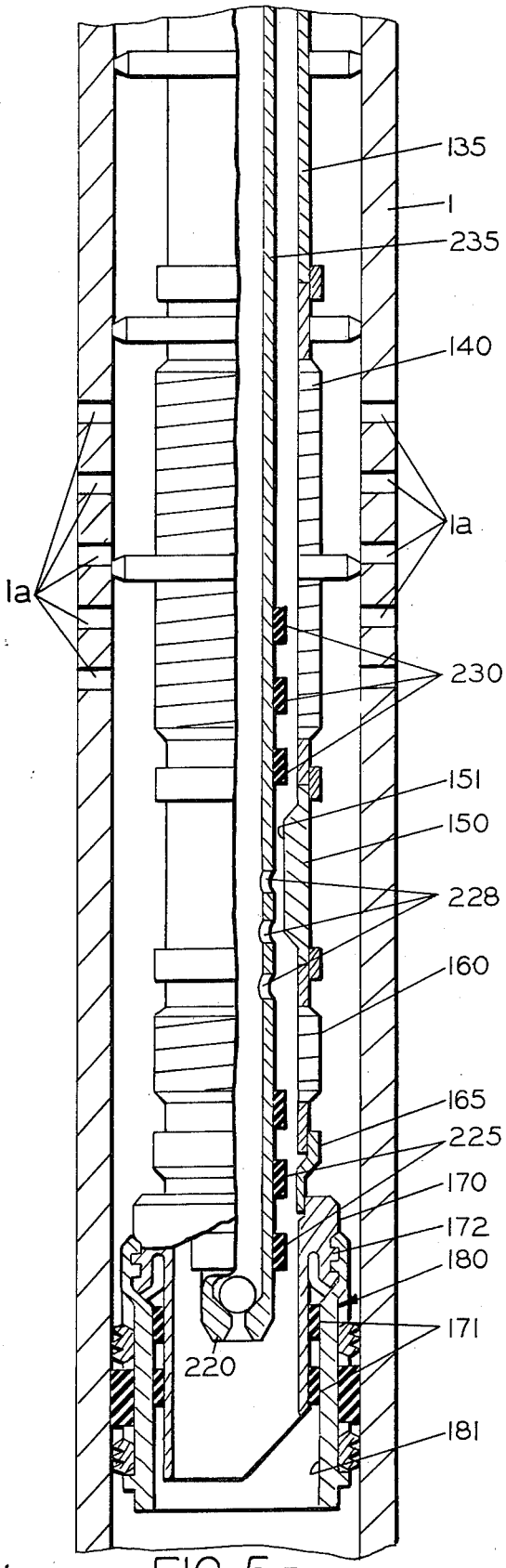
Figure 5D:
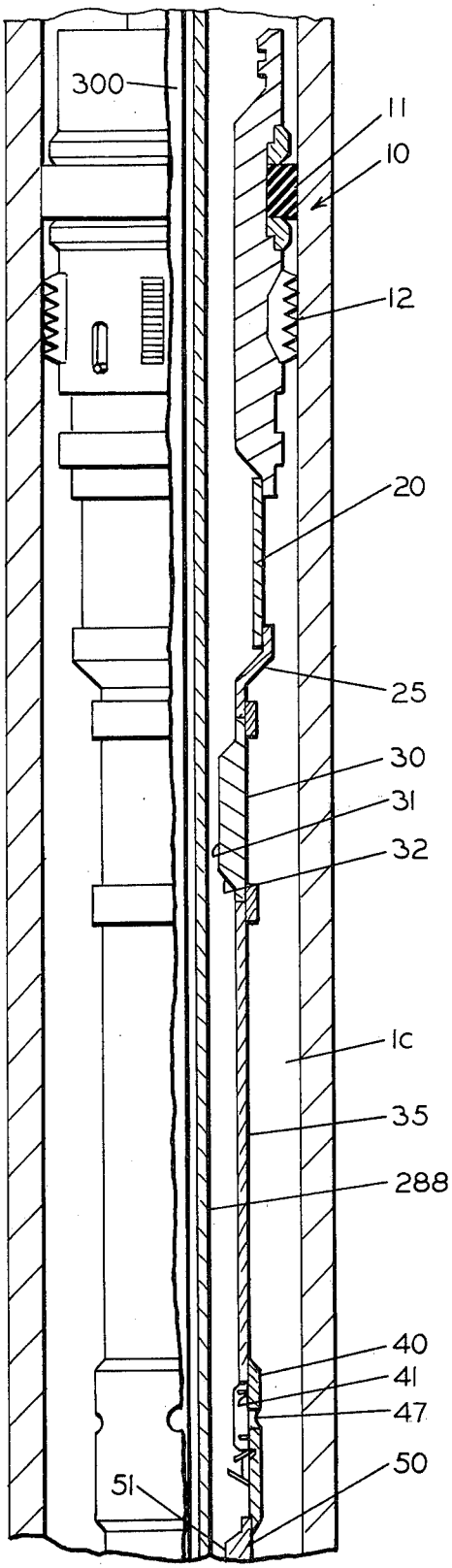
Figure 5C:
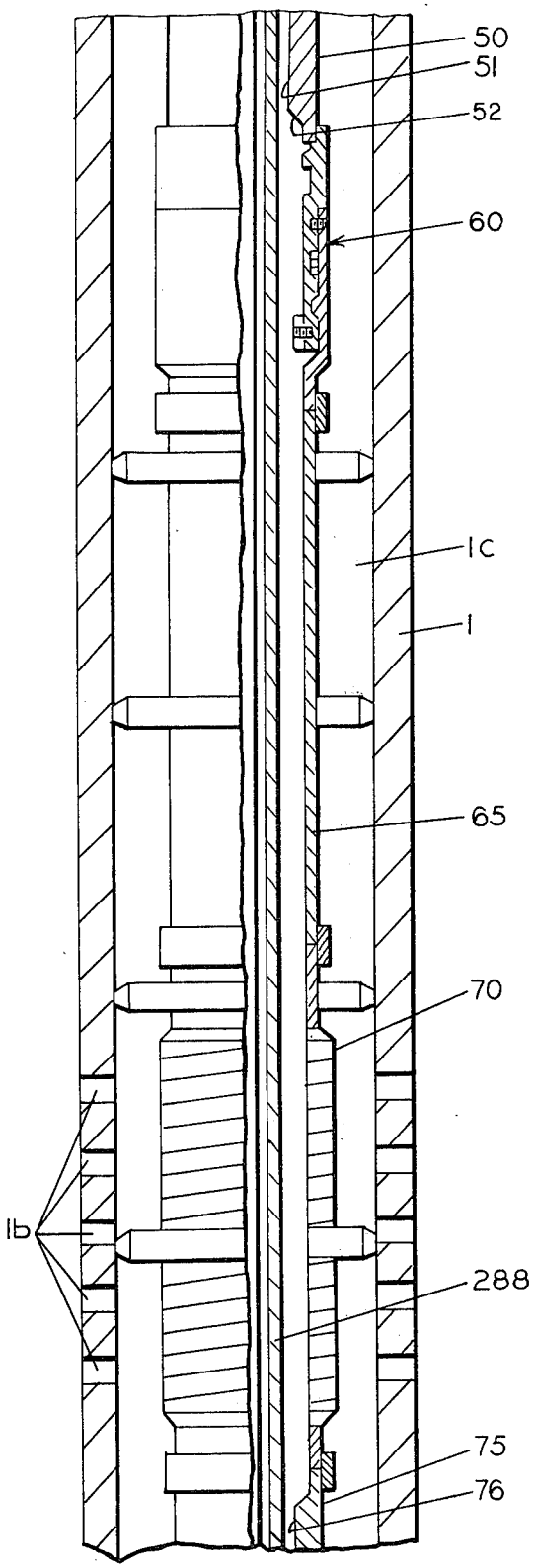

Above the cross-over port 261 there is provided a plurality of axially spaced external seals 270. These seals cooperate with the sealing surface 91 provided in the seal bore 90 (FIG. 4*c*) above the sliding sleeve 110 during the gravel packing of the lower zone, and with seal bore 30 in the upper zone (FIG. 5*d*) to prohibit fluid flow out of the cross-over port 261 and directly back up to the top of the well.

Above the seals 270, the control mandrel assembly 200 is provided with a second indicating collet 280 to indicate to the operator at the surface the relative position of the cross-over tool 260 with respect to the sliding sleeve assemblies 110 and 40. The indicating collet 280 is a compression indicator which engages the top of a seal bore, such as 90 and 30, as the control mandrel 200 is moved down.

Above the indicating collet 280, the control mandrel 200 is provided with a collet-like closing tool 285 employed to close the sliding sleeve 110 prior to setting the packer 100.

The top end of the closing tool 285 is affixed to the bottom end of an extended length of pipe 288 on top of which is mounted the setting tool 290 for the packer 10 including a seal ring 291. Above setting tool 290 is mounted a seal bore unit 295 which surrounds seal rings 301 provided on a concentric work string 300 which extends to the bore 262 of the cross-over tool 260. The setting tool 290 and the entire assembly including and below the packer 10 are run into the well on a tubular work string 5.

All of the apparatus illustrated in FIGS. 1*a*–1*e* will be hereinafter referred to as the outside screen and liner assembly. All of this apparatus is assembled to the bottom end of the packer 10 prior to insertion of the apparatus in the well.

In the same manner, all of the apparatus shown and described in connection with FIGS. 2*a*–2*c* will hereinafter be referred to as the mandrel assembly, and this assembly is inserted within the outer screen and liner assembly. Lastly, the work string 300 (FIGS. 4*c*, 4*d* and 4*e*) is run within the control mandrel assembly 200 at the appropriate time.

OPERATION

Figure 3A:
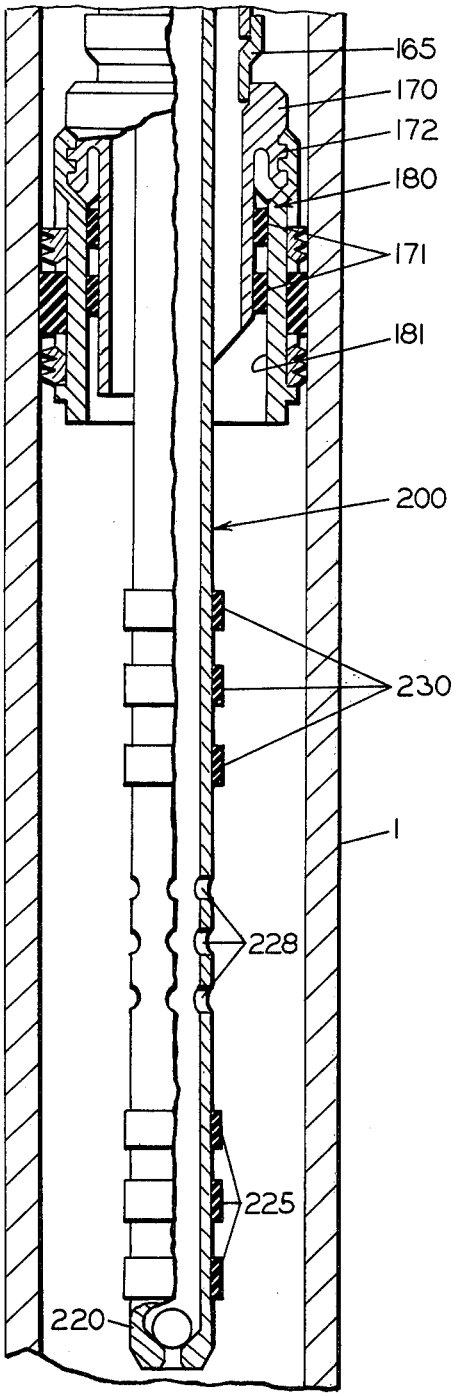
FIGS. 3*a*, 3*b*, and 3*c*, together constitute a schematic quarter section vertical elevational view of the packing apparatus of FIG. 1 with the mandrel assembly of FIG. 2 inserted within the gravel packing apparatus in position after the run in of the complete tool through the well casing to a selected depth, FIG. 3*a* being the lowermost portion of the apparatus and FIGS. 3*b* and 3*c* being successive upward continuation views.
Figure 5E:
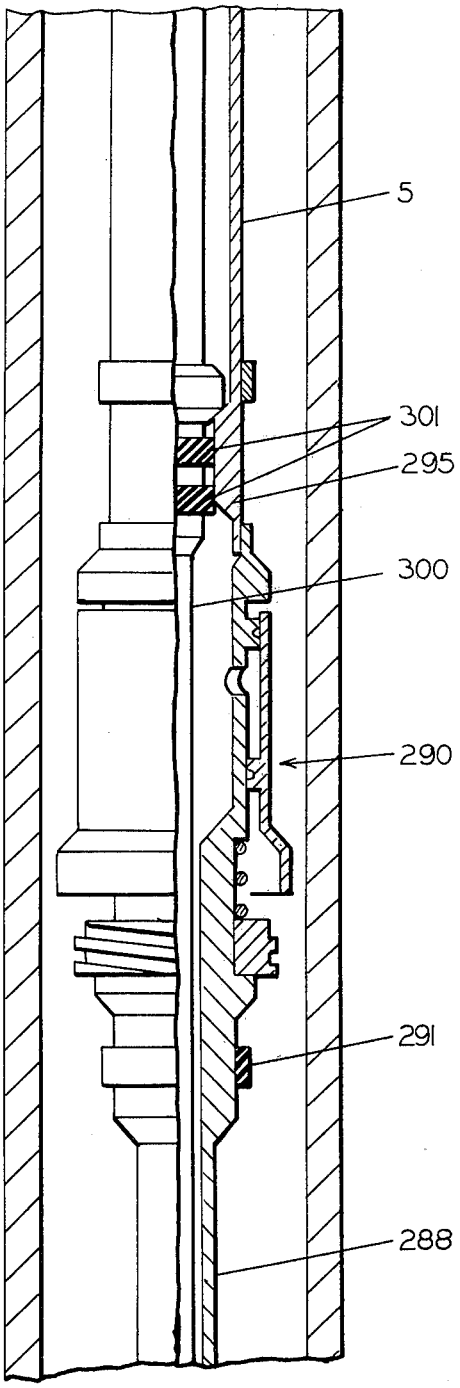
FIGS. 5*a*, 5*b*, 5*c*, 5*d* and 5*e* are views respectively similar to FIGS. 4*a*–4*e*, but with the control mandrel assembly shifted upwardly to complete the gravel packing of the lower production zone.
Figure 3C:
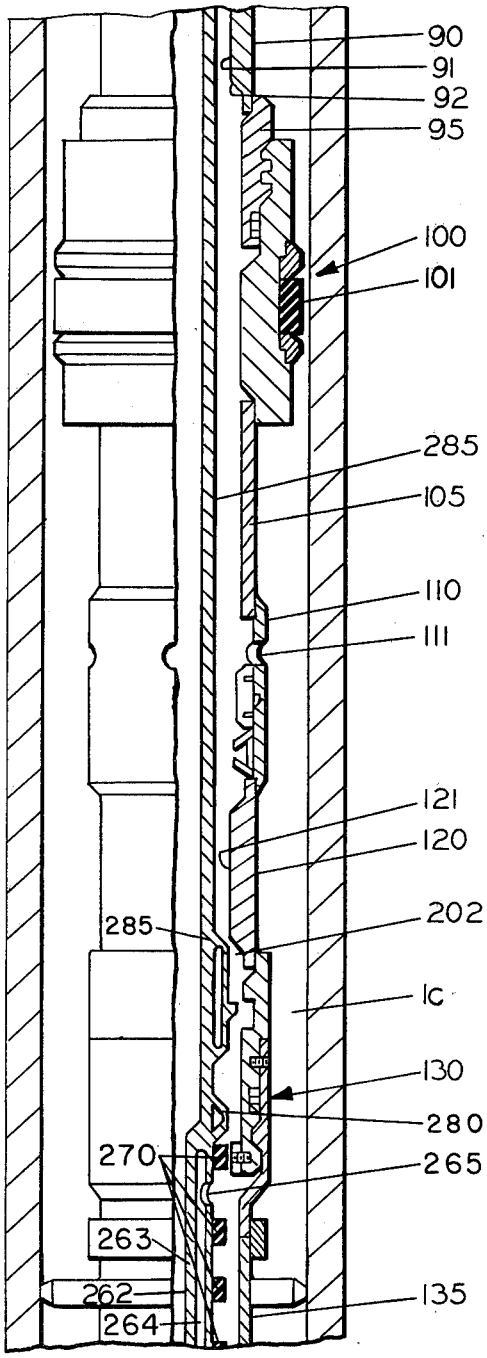
Figure 3B:
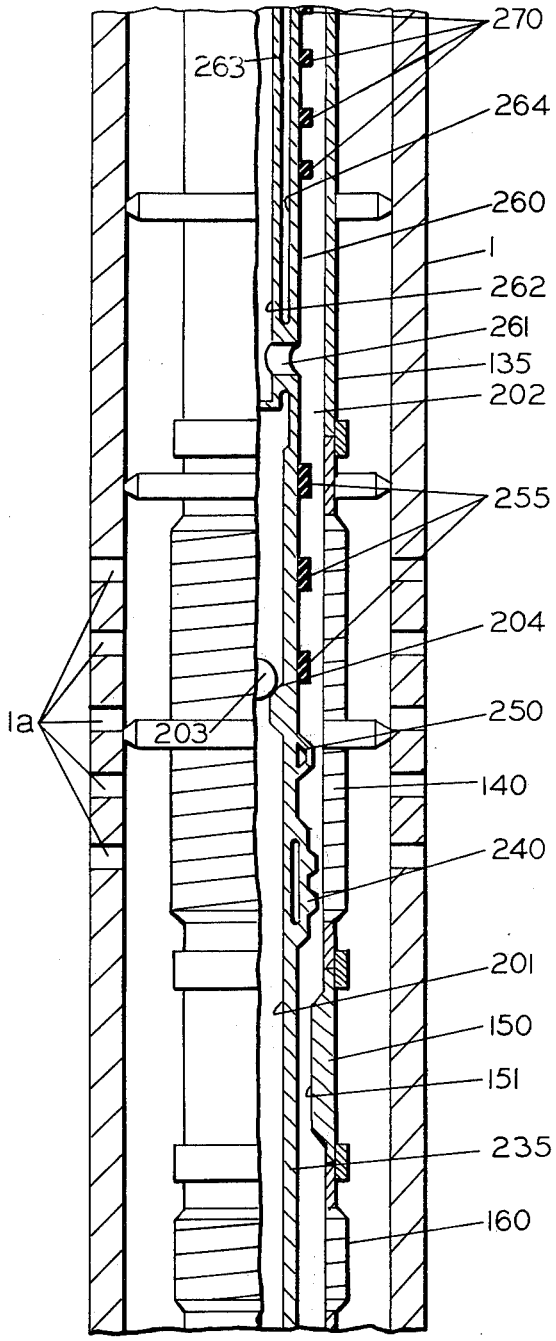

Prior to running the gravel packing assembly in the well, the lower packer 180 is anchored in the casing 1 as previously mentioned, at a pre-determined position below the lower production zone perforations 1*a*. Upon running in the entire gravel packing assembly into the well, the snap latches 172 provided on the snap latch 170 on the bottom of the screen and liner assembly are engaged with cooperating elements on the packer 180 and the external seals 171 of the snap latch 170 are sealingly engaged in the bore 181 of the packer 180, as shown in FIG. 3*a*. In this position the extreme bottom end of the control mandrel 200 represented by the check valve 220 is positioned below the packer 180 (FIG. 3*a*). The setting tool 290 now is in position to engage the packer 10. The packer 10 is set by manipulation of the setting tool 290, in a known and conventional manner.

The control mandrel assembly 200 now is moved upwardly a sufficient distance to set the cross-over tool 260 carried by control mandrel 200 in position to permit the pressure of fluid in the work string 300 to be increased to hydraulically set the packer 100. In this position, the seals 255 cooperate with seal bore surface 121 and the ports 111 of the sliding sleeve 110 are closed.

With both the upper packer 10 and the packer 100 set, the control mandrel assembly 200 is moved to the position illustrated in FIGS. 4*a*–4*e* wherein the lower locating collet 250 is somewhat below the shoulder 122 of the seal bore 120. In this position, the cross-over tool 260 will have its port 261 commuicating with the annulus 202 between the control mandrel 200 and the screen and liner assembly just above the sliding sleeve 110, whose port 111 will be in the open position. Gravel carrying fluid can thus be introduced into the aforementioned annulus to flow around the perimeter of the lower production screen 140 and downwardly around the tell-tale screen 160. The flowpath is downwardly through the wash pipe 300 into the central bore 262 of the cross-over 260, through radial port 261 into the annulus 202, through the radial port 111 in the sliding sleeve 110 and into the annulus 1*c*. Return fluid flows through tell-tale screen 160, through the passageways 228 into the annular passage 264 of the cross-over tool 260, through the ports 265 into the annulus 202 (above the seal bore 90), and then into the casing annulus above the packer 100.

The flow of such fluid which, of course, contains aggregate in the size and amount appropriate for the particular well formation, will continue until the gravel covers the lower tell-tale screen 160. This will result in a detectable increase in back pressure of the packing fluid which will indicate to the operator at the surface that the gravel has been applied to the lower end of the screen interval. After this operation, the control mandrel 200 is picked up, as shown in FIGS. 5*a*–5*e*, and fluid is continued to be pumped through the wash pipe 300 to pack the production screen 140, with the return fluid being routed through the lower production screen 140.

Figure 6A:
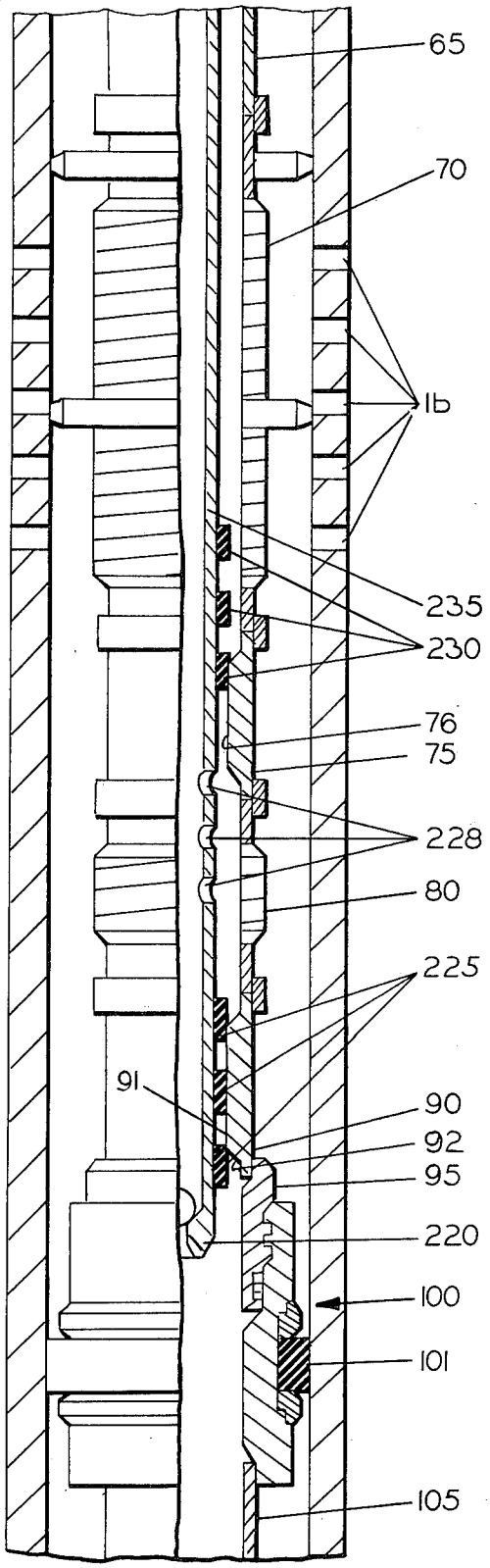
FIGS. 6*a*, 6*b* and 6*c* constitute views respectively similar to FIGS. 4*b*, 4*c* and 4*d*, but illustrating the position of the control mandrel assembly during the gravel packing of the upper production zone.
Figure 6C:
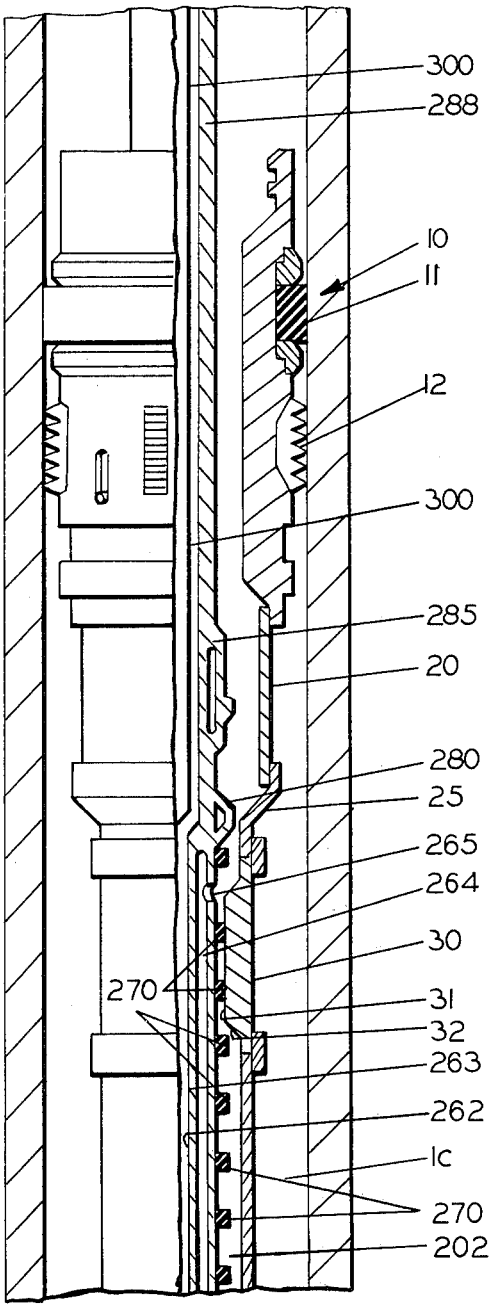
Figure 6B:
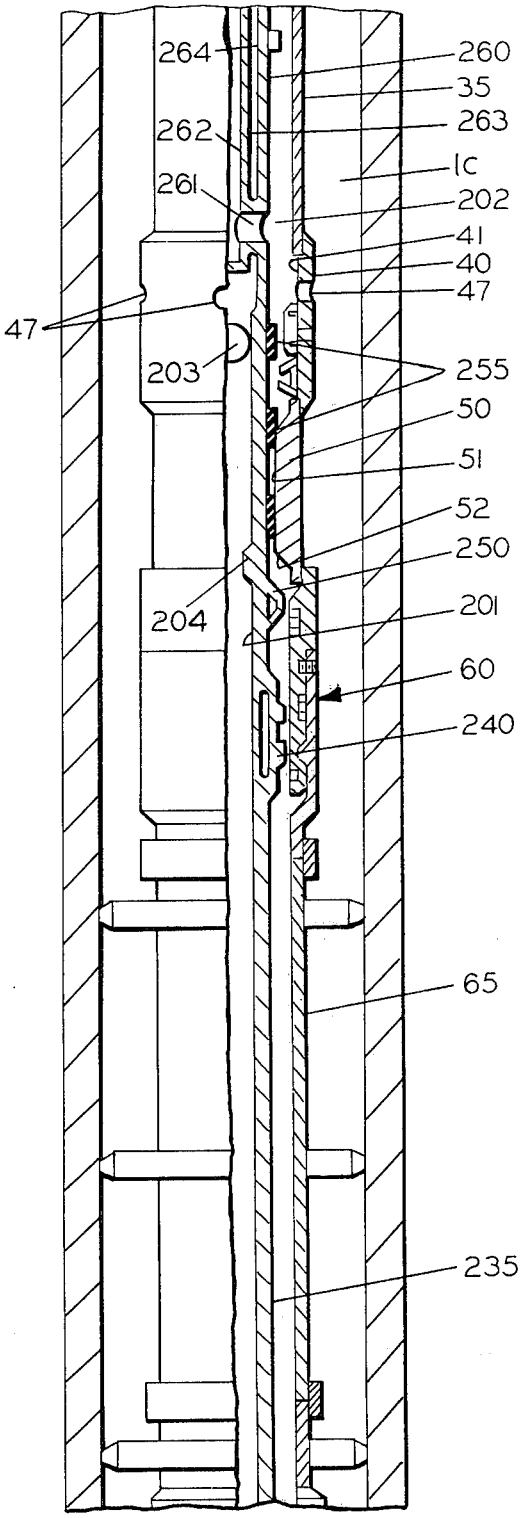

The control mandrel 200 now is moved to the position illustrated in FIGS. 6*a*, 6*b* and 6*c* wherein the check valve 220 of the control mandrel 200 is now placed above the packer 100, and the series of seals 225 surrounding the check valve of the control mandrel 200 are in sealing engagement with the inner sealing surface 91 of the seal bore 90. The raising of the mandrel 200 obviously effects the closing of the port 111 of the lower sliding sleeve assembly 110 through the action of the shifting tool 240 on such sliding sleeve.

The port 261 of the cross-over tool 260 is now positioned just above the open port 47 of the upper sliding sleeve assembly 40. The locating collet 250 is positioned just below the shoulder 52 of the seal bore 50. The seal rings 255 below the cross-over tool 260 are in sealing engagement with the inner surface 51 of the seal bore 50. Thus, the upper production zone, represented by the casing perforations 1*b* is completely isolated from the lower production zone and the gravel packing apparatus is in the same relationship with work string 300 as previously described in connection with the packing of the lower production zone.

The gravel carrying fluid can now be introduced through the work string 300 into the bore 262 of the cross-over tool 260 of the control mandrel 200, where it will flow outwardly through the port 261 of the cross-over tool 260 into the annulus 202 between the mandrel assembly 200 and the inner wall of the screen and liner assembly through the open port 47 of the sliding sleeve 40. Hence, gravel is packed around the periphery of the tell tale screen 80. When sufficient gravel has been supplied so that the pack covers the tell-tale screen 80, the back pressure of the gravel pack fluid will increase and provide a pressure signal to the operator that the packing has been completed down to the bottom of the desired screen interval.

As before, the control mandrel 200 is then raised to complete the packing of the production screen 70, which will be signalled by a pressure increase.

The control mandrel 200 may now be completely removed from the well, thus closing the ports 47 of the sliding sleeve assembly 40, and the well is ready for production with the gravel packing of the two production zones having been accomplished with a single trip of the aforedescribed gravel packing apparatus into the well.

It should be noted that the distance between the lower tell-tale screen of each gravel packing set and the sliding sleeve of each gravel packing set has to be substantially identical. This is a necessity because of the fixed distances between the sealing elements and the cross-over port of the cross-over tool incorporated in the mandrel assembly. Additionally, to successfully gravel pack a plurality of production zones in a single trip, the lengths of the individual production zones have to be substantially identical.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for effecting the sequential gravel packing of a plurality of vertically spaced production zones within a subterranean well having casing in place therein, comprising: primary sealing means adapted for setting in the casing at a position above the production zones; a plurality of sets of production screens and valve means selectively movable between open and closed positions, said sets being equal in number to the production zones, and carriable in said well with the primary sealing means, said sets extending in series below the primary sealing means; production zone isolation means connected between each said set and expansible into sealing engagement with the casing intermediate the adjacent production zones; and a tubular control mandrel carriable on a conduit in the well with said primary sealing means and movable within all said sets, said control mandrel including: a single unitary cross-over tool for diverting downward flowing gravel carrying fluid from the interior of said control mandrel to the exterior thereof through at least one radial port; a plurality of vertically spaced sealing means on said cross-over tool for successively isolating each said set from the others when said radial port of said cross-over tool is positioned in axial proximity to each valve means; said cross-over tool further defining an axial passage for upwardly flowing return fluid from the production screen of said isolated set communicating with the annulus surrounding said cross-over tool at a position above said sealing means; means on said control mandrel for opening said valve means by longitudinal movement of said control mandrel in a first direction and closing said valve means by longitudinal movement of said control mandrel in a second direction; and means for supplying gravel carrying fluid to the interior of said control mandrel, whereby each successive production zone may be gravel packed by successively moving said conduit and said control mandrel to cooperate with each of said sets, without retrieving said conduit from within said well during said sequential gravel packing of said well.

2. The apparatus of claim 1 wherein each said valve means is positioned above the production screen of each set, a seal bore being defined in each said set between the production screen and said valve means, said seal bore cooperating with at least one of said vertically spaced sealing means, whereby gravel carrying fluid is diverted from the interior of said control mandrel through said cross-over port means and said valve means to the exterior of said production screen and is isolated from the other production zones.

3. The apparatus of claim 1 further comprising a tell-tale screen connected in each said set below the production screen, the spacing between the sliding sleeve and the said tell-tale screen of each set being substantially identical.

4. An apparatus for effecting the sequential gravel packing of a plurality of vertically spaced production zones within a subterranean well having casing in place therein, comprising: primary sealing means adapted for setting in the casing at a position above the uppermost production zone; a plurality of sets of production screens and a series of connected radially ported sleeves, said sets being equal in number to the production zones, connected in series below the primary seaing means and carriable in said well with said primary sealing means; said ported sleeve including shiftable means for opening and closing said radial port; production zone isolation means connected between each set and expansible into sealing engagement with the casing intermediate the adjacent production zone; means defining a first seal bore connected between each said ported sleeve and said production screen; means defining a second seal bore connected below each said production screen; a tubular control mandrel insertable through all said sets and carriable on a conduit in the well with said primary sealing means, said control mandrel including: a single unitary cross-over tool for diverting downwardly flowing gravel carrying fluids from the interior of said control mandrel to the exterior thereof through at least one radial passage; a plurality of vertically spaced sealing means on said cross-over tool cooperable with said seal bores for successively isolating each said set from the others when said radial passage of said cross-over tool is successively positioned in axial proximity to each said ported sleeve; said cross-over tool further defining an axial passage for upwardly flowing return fluid from the production screen of said isolated set communicating with the annulus surrounding said cross-over tool at a position above said sealing means; means on said control mandrel for operating said shiftable means to port open position by downward movement of said control mandrel; and means for supplying gravel carrying fluid to the interior of said control mandrel whereby the lowermost and each successive upper production screen may be gravel packed by successively moving said conduit and control mandrel to cooperate with each of said sets without retrieving said conduit from within said sell during sequential gravel packing of said well.

5. The apparatus of claim 4 wherein the lengths of each production zone are substantially identical, and further comprising a tell-tale screen connected in each said set below the production screen, the spacing between the ported sleeve and the tell-tale screen of the set being substantially identical.

* * * * *